US009772597B2

(12) United States Patent
Inada

(10) Patent No.: US 9,772,597 B2
(45) Date of Patent: Sep. 26, 2017

(54) IMAGE FORMING APPARATUS INCLUDING PHOTOSENSITIVE DRUM, PHOTOSENSITIVE DRUM UNIT, BUSH MEMBER

(71) Applicant: KYOCERA Document Solutions Inc., Osaka-shi, Osaka (JP)

(72) Inventor: Teruhiko Inada, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/197,520

(22) Filed: Jun. 29, 2016

(65) Prior Publication Data

US 2017/0003640 A1 Jan. 5, 2017

(30) Foreign Application Priority Data

Jun. 30, 2015 (JP) ..... 2015-131856

(51) Int. Cl.
*G03G 15/00* (2006.01)

(52) U.S. Cl.
CPC ..... *G03G 15/757* (2013.01)

(58) Field of Classification Search
None
See application file for complete search history.

(56) References Cited

U.S. PATENT DOCUMENTS 5,402,207 A * 3/1995 Michlin ..... G03G 15/757 399/117
5,457,520 A 10/1995 Schell et al.
5,541,710 A * 7/1996 Stewart ..... G03G 15/0898 384/147
2001/0021315 A1* 9/2001 Mizuno ..... G03G 15/065 399/55
2007/0009286 A1* 1/2007 Bryant ..... G03G 15/757 399/117

(Continued)

FOREIGN PATENT DOCUMENTS

JP 01277867 A * 11/1989
JP 09090853 A 4/1997

(Continued)

OTHER PUBLICATIONS

European Patent Office, Extended European Search Report Issued in Application No. 16177233.0, dated Nov. 9, 2016, Germany, 7 pages.

*Primary Examiner* — Sevan A Aydin
(74) *Attorney, Agent, or Firm* — Alleman Hall Creasman & Tuttle LLP

(57) ABSTRACT

This image forming apparatus includes a photosensitive drum, a shaft portion, a support portion, and a bush member. The photosensitive drum is configured to hold a toner image to be transferred to a sheet member. The shaft portions are connected to both ends in an axial direction of the photosensitive drum, and project outward in the axial direction from a center of the photosensitive drum. The support portions have shaft holes through which the shaft portions are inserted, and are configured to rotatably support the shaft portions. The bush members are interposed between inner surfaces of the shaft holes and outer circumferential surfaces of the shaft portions, and are each formed in an arc shape having a slit extending in the axial direction.

7 Claims, 11 Drawing Sheets

(56) References Cited

U.S. PATENT DOCUMENTS

| | | | | |
|---|---|---|---|---|
| 2007/0092311 | A1 | 4/2007 | Fujimoto | |
| 2007/0104508 | A1* | 5/2007 | Oh | G03G 15/1685 399/121 |
| 2007/0147895 | A1 | 6/2007 | Hayakawa | |
| 2008/0193175 | A1* | 8/2008 | Fujimoto | G03G 15/2053 399/320 |
| 2009/0036221 | A1 | 2/2009 | Morimoto | |
| 2011/0156464 | A1 | 6/2011 | Izawa et al. | |
| 2012/0328342 | A1* | 12/2012 | Takematsu | G03G 15/0189 399/333 |
| 2013/0016997 | A1* | 1/2013 | Ueno | H02K 5/24 399/167 |
| 2013/0259523 | A1* | 10/2013 | Kim | G03G 21/181 399/111 |
| 2013/0336607 | A1* | 12/2013 | Hirose | F16C 33/103 384/397 |
| 2014/0072328 | A1* | 3/2014 | Kanno | G03G 15/0898 399/103 |
| 2014/0348522 | A1* | 11/2014 | Tomono | G03G 15/50 399/44 |

FOREIGN PATENT DOCUMENTS

| | | | | |
|---|---|---|---|---|
| JP | H10196671 | A | | 7/1998 |
| JP | 2010139606 | A | * | 6/2010 |

* cited by examiner

IMAGE FORMING APPARATUS INCLUDING PHOTOSENSITIVE DRUM, PHOTOSENSITIVE DRUM UNIT, BUSH MEMBER

INCORPORATION BY REFERENCE

This application is based upon and claims the benefit of priority from the corresponding Japanese Patent Application No. 2015-131856 filed on Jun. 30, 2015, the entire contents of which are incorporated herein by reference.

BACKGROUND

The present disclosure relates to an image forming apparatus including a photosensitive drum, a photosensitive drum unit provided in an image forming apparatus, and a bush member used for supporting a photosensitive drum.

An image forming apparatus of an electrophotographic type includes a photosensitive drum on which a toner image is formed by a developing device. The toner image formed on the photosensitive drum is transferred to a sheet member by a transfer device. The photosensitive drum is rotatably supported by a frame or the like. In one example of known structures, drive receiving portions are provided at both ends of the photosensitive drum, and shaft portions of the drive receiving portions are rotatably supported. In another example of known structures, in order to reduce resistance with a bearing portion, the shaft portion is rotatably supported via a ring-shaped bush member formed of a highly slidable resin material.

In general, in the case of rotatably supporting the shaft by the bearing portion, so-called runout occurs in which the center of the shaft is shifted in the radial direction relative to the center of the bearing portion. In the case where the bush member is used for supporting the shaft portion, the bush member expands or contracts in the radial direction due to variation in the ambient temperature. Therefore, the geometric tolerance (runout tolerance) for the shift amount of the runout is greater than that in the case of not using the bush member. Conventionally, under the assumption that the outer diameter size of the bush member increases due to expansion, the dimensions of the gap (space where the bush member is stored) between a shaft portion of a supported subject and the bearing portion are designed.

SUMMARY

An image forming apparatus according to one aspect of the present disclosure includes a photosensitive drum, a shaft portion, a support portion, and a bush member. The photosensitive drum is configured to hold a toner image to be transferred to a sheet member. The shaft portions are connected to both ends in an axial direction of the photosensitive drum, and project outward in the axial direction from a center of the photosensitive drum. The support portions have shaft holes through which the shaft portions are inserted, and are configured to rotatably support the shaft portions. The bush members are interposed between inner surfaces of the shaft holes and outer circumferential surfaces of the shaft portions, and are each formed in an arc shape having a slit extending in the axial direction.

A photosensitive drum unit according to another aspect of the present disclosure is provided in an image forming apparatus. The photosensitive drum unit includes a photosensitive drum, a shaft portion, a support portion, and a bush member. The photosensitive drum is configured to hold a toner image to be transferred to a sheet member. The shaft portions are connected to both ends in an axial direction of the photosensitive drum, and project outward in the axial direction from a center of the photosensitive drum. The support portions have shaft holes through which the shaft portions are inserted, and are configured to rotatably support the shaft portions. The bush members are interposed between inner surfaces of the shaft holes and outer circumferential surfaces of the shaft portions, and are each formed in an arc shape having a slit extending in the axial direction.

A bush member according to still another aspect of the present disclosure is used for supporting a photosensitive drum of an image forming apparatus. The bush member is provided between each of shaft portions provided at both ends in an axial direction of a photosensitive drum provided in an image forming apparatus, and a shaft hole through which each shaft portion is inserted, and the bush member has an arc shape having a slit extending in the axial direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
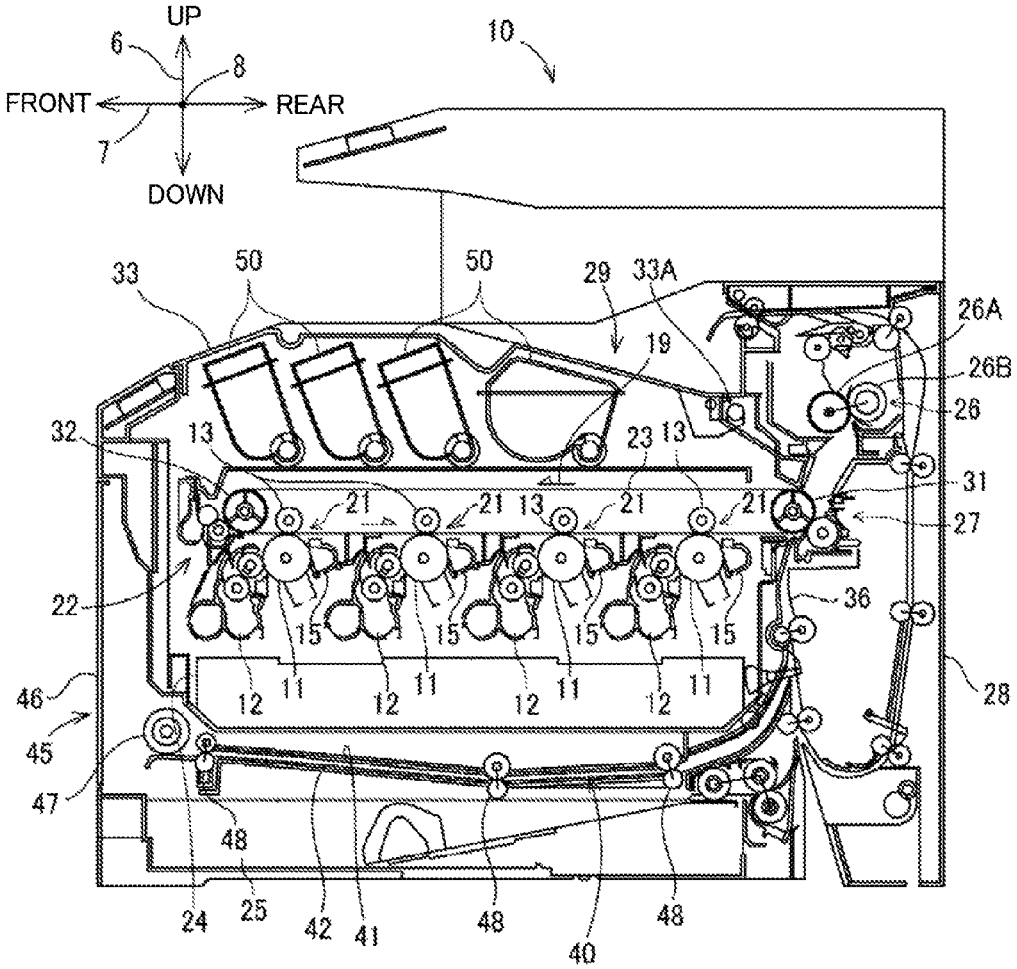
FIG. 1 is a view showing the configuration of an image forming apparatus according to an embodiment of the present disclosure.

Hereinafter, embodiments of the present disclosure will be described with reference to the accompanying drawings. The following embodiments are examples in which the present disclosure is embodied, and do not limit the technical scope of the present disclosure. In the following description, an up-down direction 6 is defined in the state (state shown in FIG. 1) in which an image forming apparatus 10 is placed on a flat support surface. A front-rear direction 7 is defined such that the left side on the drawing plane in FIG. 1 is the front side (front surface side) of the image forming apparatus 10. A right-left direction 8 (direction perpendicular to the drawing plane in FIG. 1) is defined as seen from the front side of the image forming apparatus 10 in FIG. 1. Therefore, the near side with respect to the drawing plane in FIG. 1 is the right side of the image forming apparatus 10, and the far side is the left side.

The image forming apparatus 10 is a so-called tandem-type color printer. The image forming apparatus 10 prints an image on a print sheet (sheet member) having a sheet shape, using a developer containing toner.

As shown in FIG. 1, the image forming apparatus 10 mainly includes four image forming portions 21, an intermediate transfer unit 22, a sheet feed cassette 25, a fixing device 26, a secondary transfer device 27, a laser scanning unit 24, and four toner containers 50. These components are attached to an apparatus body 28 as a case forming an external frame (not shown), an internal frame (not shown), and the like of the image forming apparatus 10.

The four image forming portions 21 are provided below the intermediate transfer unit 22, inside the apparatus body 28. Each image forming portion 21 executes an image forming process for forming an image on a print sheet on the basis of a so-called electrophotographic method. Specifically, each image forming portion 21 prints an image on a print sheet on the basis of image data inputted from the outside via a network communication portion (not shown). Each image forming portion 21 includes a photosensitive drum 11, a charging device, a developing device 12, a primary transfer device 13, a cleaning device 15, and the like.

The photosensitive drum 11 holds a toner image to be transferred to a print sheet. In the image forming process, the photosensitive drum 11 is caused to carry a toner image thereon, by the developing device 12. While the photosensitive drum 11 is rotationally driven, the photosensitive drum 11 carries a toner image corresponding to an electrostatic latent image formed on the outer circumferential surface thereof. The photosensitive drum 11 is formed in a cylindrical shape, and has a thin layer of amorphous silicon (a-Si) based material formed on the surface of an element tube made of aluminum.

The intermediate transfer unit 22 is provided above the image forming portions 21. At both ends in the front-rear direction 7 of the intermediate transfer unit 22, a driving pulley 31 and a driven pulley 32 are provided. A transfer belt 23 is supported being stretched between the driving pulley 31 and the driven pulley 32. Thus, the transfer belt 23 extends in the front-rear direction 7 with the belt surface thereof being horizontal. The transfer belt 23 is allowed to move (run) in the direction of an arrow 19 while the surface thereof is in contact with the surfaces of the photosensitive drums 11.

The secondary transfer device 27 transfers, to a print sheet, a toner image transferred to the transfer belt 23 and composed of a plurality of colors. The print sheet on which the toner image has been transferred is conveyed to the fixing device 26. The fixing device 26 fixes, to the print sheet, the toner image transferred to the print sheet, by heat. The fixing device 26 includes a heating roller 26A which is heated at a high temperature, and a pressure roller 26B opposed to the heating roller 26A. The print sheet conveyed to the fixing device 26 is conveyed while being nipped with a predetermined energizing force at a nip portion between the heating roller 26A and the pressure roller 26B, whereby the toner image is melted and fixed on the print sheet. Thereafter, the print sheet is discharged to a sheet discharge tray 29 provided at the upper portion of the apparatus body 28.

The four toner containers 50 are provided above the intermediate transfer unit 22. The four toner containers 50 are arranged in a row in the front-rear direction 7 along the transfer belt 23, inside the apparatus body 28. Each toner container 50 is configured to supply toner to the developing device 12 for the corresponding color.

The laser scanning unit 24 is provided below the image forming portions 21, in more detail, between the image forming portions 21 and the sheet feed cassette 25. The laser scanning unit 24 includes a laser light source which emits a laser beam for each color, a polygon mirror as a scanning member for scanning with the laser beam, a motor for rotationally driving the polygon mirror, a mirror for applying the scanned laser beam, and the like. On the basis of inputted image data for each color, the laser scanning unit 24 applies a laser beam to the photosensitive drum 11 of each image forming portion 21, thereby forming an electrostatic latent image on each photosensitive drum 11.

A conveyance path 40 is formed between the laser scanning unit 24 and the sheet feed cassette 25. An upper guide member 41 and a lower guide member 42 are provided below the laser scanning unit 24. The upper guide member 41 and the lower guide member 42 are located with a predetermined interval therebetween, so as to be opposed to each other in the up-down direction 6. The space between the upper guide member 41 and the lower guide member 42 corresponds to the conveyance path 40. The upper guide member 41 extends along the bottom surface of the laser scanning unit 24 and in the front-rear direction 7 of the image forming apparatus 10, and the conveyance path 40 also extends in the same direction. On the rear side of the image forming apparatus 10, a vertical conveyance path 36 is formed. On the rear side, the conveyance path 40 is connected to the vertical conveyance path 36.

A sheet feed portion 45 of a manual type is provided on the front surface side of the image forming apparatus 10. The sheet feed portion 45 feeds a print sheet through the conveyance path 40 and the vertical conveyance path 36 to the secondary transfer device 27, in the image forming apparatus 10. The sheet feed portion 45 includes a sheet receiving portion 46 and a feeding portion 47. The sheet receiving portion 46 also serves as a cover for the front surface of the apparatus body 28 of the image forming apparatus 10. The sheet receiving portion 46 is configured to allow the entrance port of the conveyance path 40 to be opened and closed with respect to the front surface of the apparatus body 28. In FIG. 1, the sheet receiving portion 46 is closed with respect to the front surface of the apparatus body 28. When the sheet receiving portion 46 is opened with respect to the front surface of the apparatus body 28 and the inner surface of the sheet receiving portion 46 is turned to face upward, a print sheet with a predetermined size can be placed on the inner surface. The print sheet placed on the sheet receiving portion 46 is fed to the conveyance path 40 by the feeding portion 47. In the conveyance path 40, a conveyance roller pair 48 is provided, and the print sheet in the conveyance path 40 is conveyed rearward by the conveyance roller pair.

Figure 2:
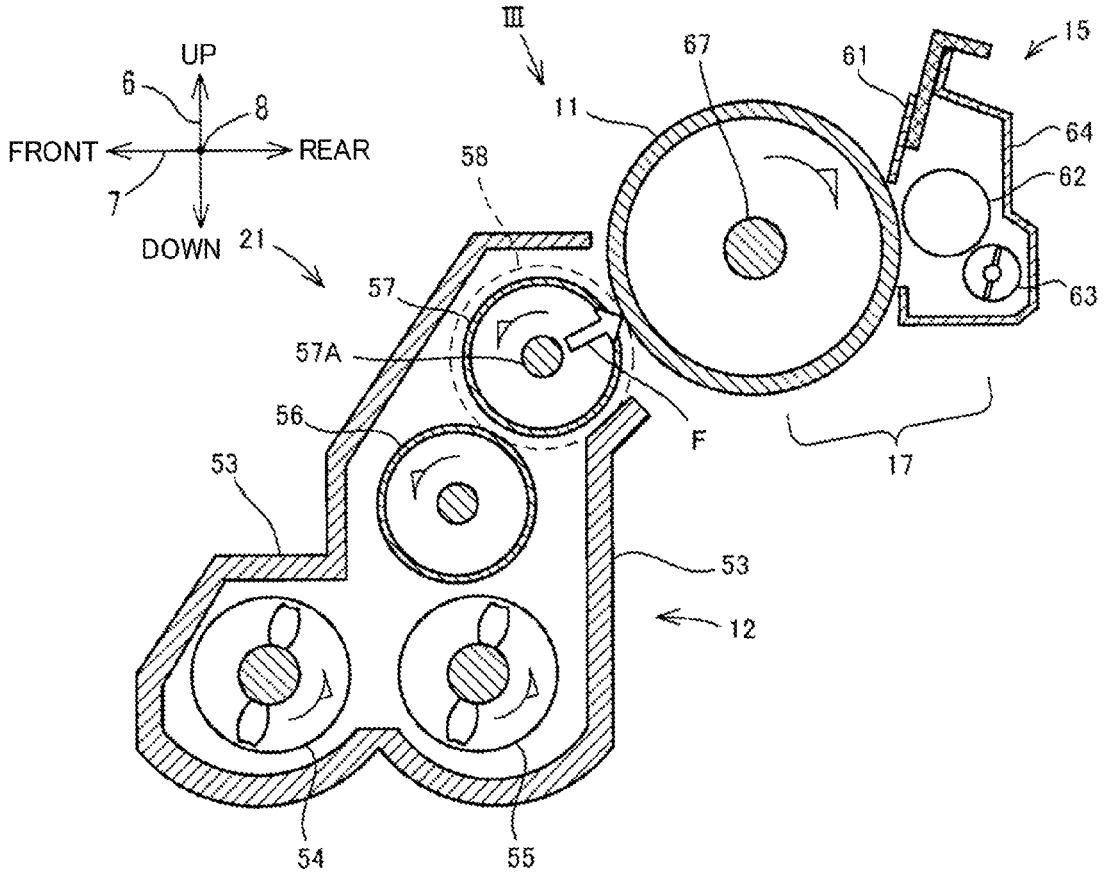
FIG. 2 is a sectional view showing the configuration of an image forming portion provided in the image forming apparatus.

FIG. 2 is a sectional view showing the configuration of the developing device 12 provided in the image forming portion 21. The developing device 12 develops the electrostatic latent image with toner by a development method in which toner is electrostatically adhered to the photosensitive drum 11 in a contactless manner. As shown in FIG. 2, the developing device 12 includes a housing 53, a first agitation screw 54, a second agitation screw 55, a magnetic roller 56, a developing roller 57 (an example of a developing roller of the present disclosure), a rotary roller 58, and the like. In the bottom portion of the housing 53, a two-component developer containing toner is stored, and the developer is conveyed while being agitated by the first agitation screw 54 and the second agitation screw 55. The magnetic roller 56 picks up, by a magnetic pole included therein, the developer from the second agitation screw 55, and causes only the toner contained in the developer to be adhered to the surface of the developing roller 57. The developing roller 57 is provided with a predetermined gap from the outer circumferential surface of the photosensitive drum 11. The toner held on the developing roller 57 is adhered to an electrostatic latent image on the photosensitive drum 11, by a potential difference applied between the developing roller 57 and the photosensitive drum 11.

Figure 3:
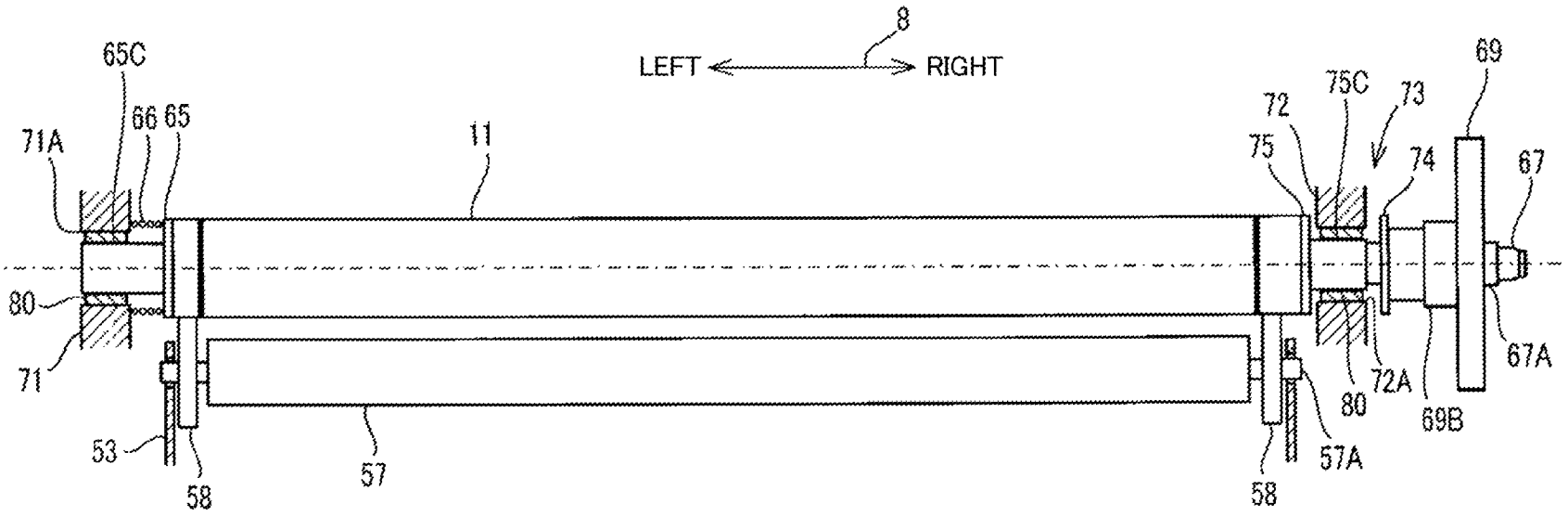
FIG. 3 is a view showing the support configuration for a photosensitive drum and a developing roller as seen from the direction of an arrow III in FIG. 2.

As shown in FIG. 3, the rotary rollers 58 are provided at both ends in the axial direction of a rotary shaft 57A of the developing roller 57. The rotary rollers 58 are pivotally supported by the rotary shaft 57A, while being pressed to both end portions of the outer circumferential surface of the photosensitive drum 11 with a predetermined energizing force F. The radius of the rotary rollers 58 is greater than the radius of the developing roller 57 by the gap between the developing roller 57 and the photosensitive drum 11. Thus, by the rotary rollers 58, the developing roller 57 is positioned at a position separated from the photosensitive drum 11 by the predetermined gap. As a configuration for giving the energizing force F from the rotary rollers 58 to the photosensitive drum 11, for example, the configuration in which both ends of the rotary shaft 57A are energized toward the center of the photosensitive drum 11 by using an elastic member such as a spring, may be applied.

The cleaning device 15 removes toner left on the photosensitive drum 11. The cleaning device 15 is provided on the rear side of the photosensitive drum 11. The cleaning devices 15 are provided for the respective photosensitive drums 11. Each cleaning device 15 includes, as cleaning members, a cleaning blade 61, a cleaning roller 62, a screw member 63, and a housing 64 (an example of a frame member of the present disclosure). The cleaning blade 61 and the cleaning roller 62 are supported by the housing 64. The cleaning blade 61 and the cleaning roller 62 have almost the same length as the photosensitive drum 11. The end of the cleaning blade 61 is in contact with or close to the surface of the photosensitive drum 11. The cleaning roller 62 is rotatably supported in the housing 64. The cleaning roller 62 is rotated by a rotational drive force being inputted to the shaft thereof. When the photosensitive drum 11 is rotated, the cleaning blade 61 removes the toner left on the surface of the photosensitive drum 11 after the transferring by the primary transfer device 13. The removed toner (waste toner) moves to the bottom of the housing 64, due to the gravitation or by the rotational force of the cleaning roller 62. The waste toner that has moved to the bottom of the housing 64 is conveyed by the screw member 63 rotating. A discharge port (not shown) is formed in the side wall at the right end of the housing 64. The waste toner is discharged through the discharge port to the outside.

In the present embodiment, the photosensitive drum 11 is supported by the housing 64, and the cleaning device 15 and the photosensitive drum 11 are formed integrally. In other words, the photosensitive drum 11 and the cleaning device 15 are unitized as a drum unit 17. The drum unit 17 is an example of a photosensitive drum unit of the present disclosure. A support mechanism for the photosensitive drum 11 in the housing 64 will be described later.

The housing 64 is attachable to and detachable from a support frame of the image forming portion 21, or the like. That is, the drum unit 17 is attachable to and detachable from the support frame of the image forming portion 21.

As shown in FIG. 3, a flange 65 is provided at one side (left) end of the photosensitive drum 11. The flange 65 is fitted to the inner hole at the side end of the photosensitive drum 11 so as to be integrally fixed (joined). A flange 75 is provided at the other side (right) end of the photosensitive drum 11. The flange 75 is a member forming a part of a drive transmission mechanism 73. The flange 75 is fitted to the inner hole at the other side end of the photosensitive drum 11 so as to be integrally fixed (joined). The flange 65 and the flange 75 have shaft holes at their respective centers. A rotary shaft 67 described later is inserted through the shaft hole of the flange 65 and the shaft hole of the flange 75. Between each shaft hole and the rotary shaft 67, a sliding clearance is formed so that the rotary shaft 67 can rotate.

Figure 6:
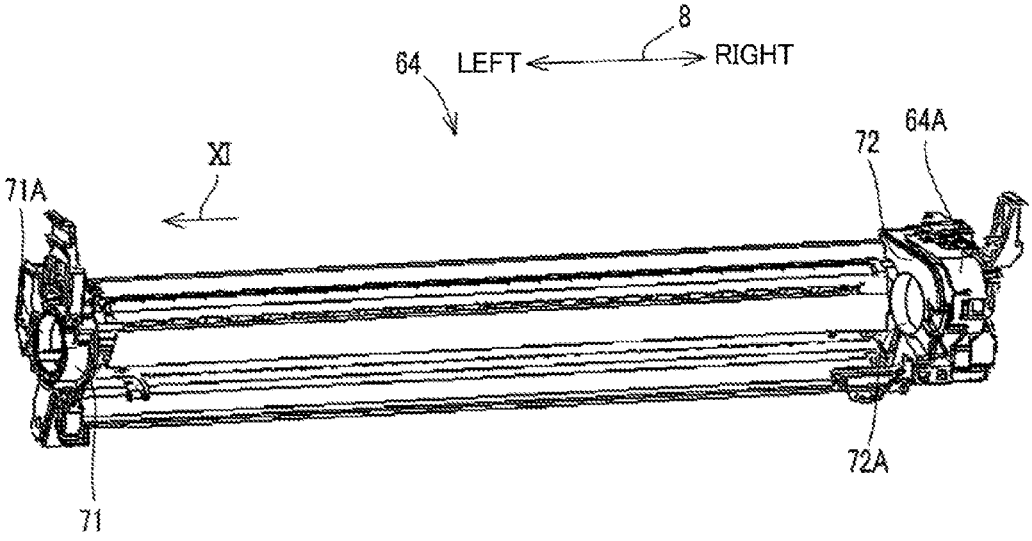
FIG. 6 is a perspective view showing a housing of a cleaning device.

The photosensitive drum 11 is supported by support portions 71 and 72 separated from each other in the right-left direction 8. The support portions 71 and 72 are parts of the housing 64 forming the case of the cleaning device 15. Specifically, as shown in FIG. 6, the support portions 71 and 72 are provided at both ends in the longitudinal direction of the housing 64. The support portion 71 has a bearing hole 71A, and the support portion 72 has a bearing hole 72A. Shaft portions 65C and 75C of the flanges 65 and 75 are inserted through the bearing holes 71A and 72A. The shaft portions 65C and 75C of the flanges 65 and 75 are rotatably supported by the bearing holes 71A and 72A via bush members 80 described later. In FIG. 3, although the support portions 71 and 72 are shown, the entire housing 64 is not shown.

As shown in FIG. 3, a coil spring 66 is provided between the flange 65 and the support portion 71. The coil spring 66 energizes the photosensitive drum 11 in the direction (rightward) away from the support portion 71 along the axial direction of the photosensitive drum 11, with a predetermined spring force. In the present embodiment, the coil spring 66 operates as a compression spring, and is held with the shaft portion 65C of the flange 65 inserted therethrough. Thus, the photosensitive drum 11 is positioned toward the other side (right side) in the axial direction.

In the housing 64 of the cleaning device 15, as well as the photosensitive drum 11, the drive transmission mechanism 73, a drive input gear 69, and the rotary shaft 67 are provided.

Figure 4:
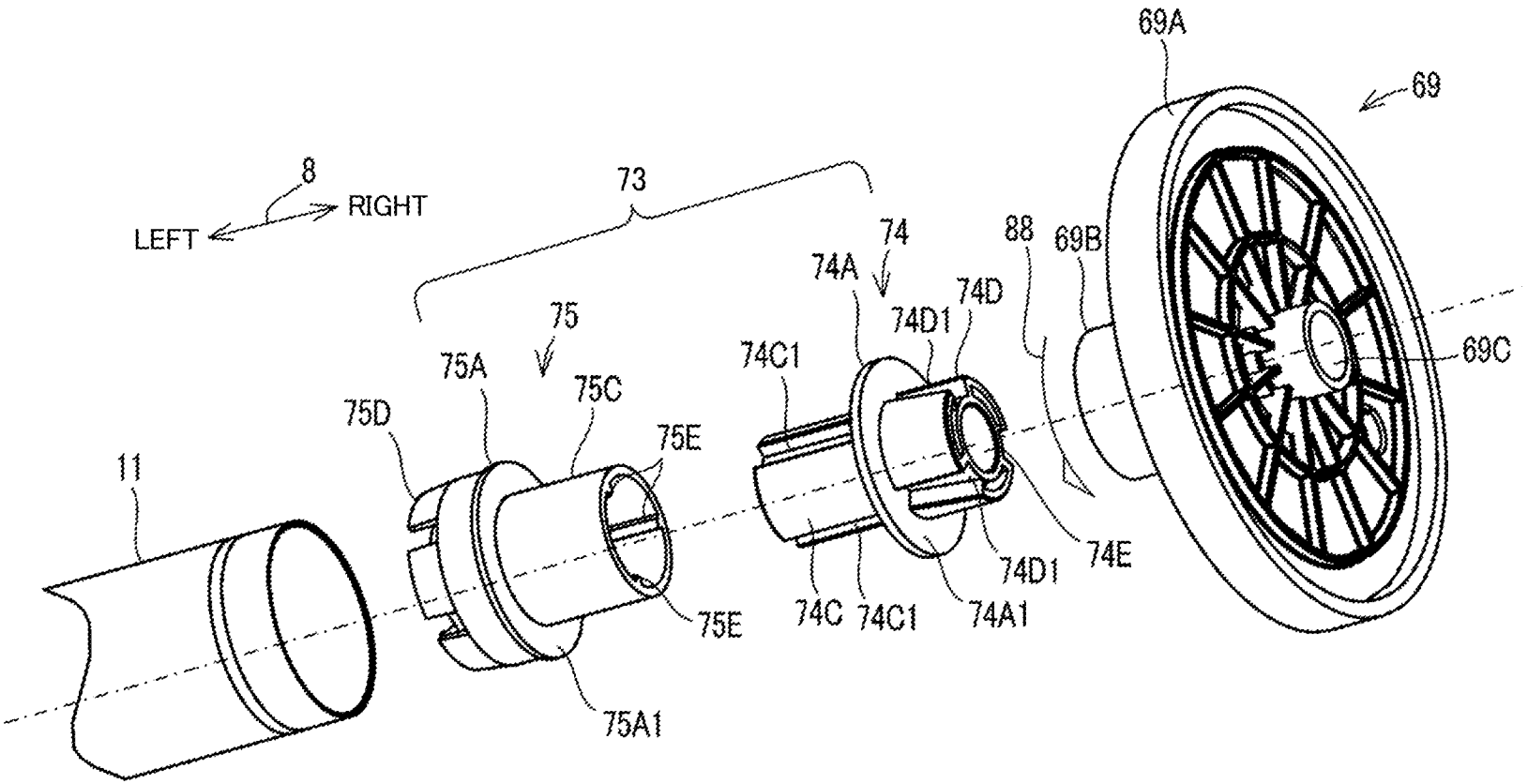
FIG. 4 is an exploded perspective view showing the configuration of a drive transmission mechanism.

As shown in FIG. 3 and FIG. 4, the drive transmission mechanism 73 and the drive input gear 69 are provided on the other side (right side) of the photosensitive drum 11. The drive input gear 69 is attached at an end portion 67A of the rotary shaft 67. The drive transmission mechanism 73 is provided between the right end of the photosensitive drum 11 and the drive input gear 69. The drive transmission mechanism 73 and the drive input gear 69 are housed in a gear box 64A (see FIG. 6) provided at one end of the housing 64. The drive input gear 69 is a part that receives a rotational drive force transmitted from a drive source such as a motor (not shown). The rotational drive force is transmitted to the drive transmission mechanism 73, as a force for rotating the photosensitive drum 11 in one direction indicated by the rotational direction (hereinafter, referred to as a rotational direction 88) indicated by an arrow 88.

As shown in FIG. 4, the drive input gear 69 has a gear portion 69A and a transmission portion 69B. The gear portion 69A is a so-called spur gear with teeth formed on the outer circumferential surface of the disk-like base body. The transmission portion 69B having a cylindrical shape projects from one side surface of the gear portion 69A. A shaft hole 69C is formed at the center of the drive input gear 69. The rotary shaft 67 is inserted through the shaft hole 69C. Thus, the drive input gear 69 is rotatably supported by the rotary shaft 67.

The transmission portion 69B is formed integrally with the gear portion 69A. The transmission portion 69B is formed in a cylindrical shape having a hollow therein. The transmission portion 69B has therein a hollow having a greater inner diameter than the shaft hole 69C, and communicates with the shaft hole 69C. At the end in the axial direction of the transmission portion 69B, engagement nails (not shown) are formed which have such a nail shape that can be engaged with engagement grooves 74D1 of a joint 74 described later. The engagement nails are configured to be engaged with the engagement grooves 74D1 of the joint 74 in the circumferential direction of the rotary shaft 67.

The drive transmission mechanism 73 is composed of the joint 74 and the flange 75. These members operate in coordination with each other, whereby the photosensitive drum 11 rotates in the rotational direction 88 in response to input of the rotational drive force in the rotational direction 88 to the drive input gear 69.

The joint 74 receives the rotational drive force in the rotational direction 88 inputted to the drive input gear 69, and transmits the rotational drive force to the flange 75. As shown in FIG. 4, the joint 74 has a disk-like base body 74A, a cylinder portion 74C, and a cylinder portion 74D. The cylinder portion 74D is provided on a side surface 74A1 on the drive input gear 69 side of the base body 74A. The cylinder portion 74C is provided on a side surface on the flange 75 side of the base body 74A. A shaft hole 74E is formed at the center of the joint 74. The rotary shaft 67 is inserted through the shaft hole 74E.

The cylinder portion 74D extends rightward in the axial direction from the side surface 74A1. Three engagement grooves 74D1 extending in the axial direction are formed on the outer circumferential surface of the cylinder portion 74D. The cylinder portion 74D is formed in such a size as to be able to be inserted into the inner hole of the transmission portion 69B of the drive input gear 69. In the present embodiment, the cylinder portion 74D is inserted into the transmission portion 69B, whereby the joint 74 and the drive input gear 69 are connected. When the cylinder portion 74D is inserted into the transmission portion 69B, the engagement nails of the drive input gear 69 are inserted into the engagement grooves 74D1. Thus, the engagement grooves 74D1 and the engagement nails are engaged with each other in the rotational direction 88.

The cylinder portion 74C extends leftward in the axial direction from the side surface on the flange 75 side. In the outer circumferential surface of the cylinder portion 74C, three long grooves 74C1 elongated in the axial direction are formed. Ribs 75E provided on the flange 75 described later are inserted into the long grooves 74C1. When the ribs 75E are inserted into the long grooves 74C1, the ribs 75E and the engagement grooves 74D1 are engaged in the rotational direction 88. The long grooves 74C1 only need to be configured so as to allow the ribs 75E to be inserted therein, and the number and the shape thereof are not limited.

The flange 75 is attached at the right end of the photosensitive drum 11. The flange 75 is a resin member formed of a crystalline resin, and is formed of, for example, polyacetal (POM) which has a small friction coefficient and is highly slidable. The flange 75 is configured so as to be connected with the cylinder portion 74C of the joint 74 and engaged with the joint 74 in the rotational direction 88. Thus, the flange 75 receives the rotational drive force in the rotational direction 88 from the joint 74.

Specifically, the flange 75 has a disk-like base body 75A, the shaft portion 75C, a press-fit portion 75D, and the ribs 75E.

The shaft portion 75C is provided on a side surface 75A1 on the joint 74 side of the base body 75A. The press-fit portion 75D is provided on the photosensitive drum 11 side of the base body 75A. At the center of the flange 75, specifically, at the center of the press-fit portion 75D, a shaft hole (not shown) is formed. The rotary shaft 67 is inserted through the shaft hole.

The press-fit portion 75D is a cylinder part projecting leftward in the axial direction from the base body 75A. The press-fit portion 75D is fitted to the inner hole of the photosensitive drum 11. Thus, the press-fit portion 75D is fixed to the photosensitive drum 11.

The shaft portion 75C extends rightward in the axial direction from the center of the side surface 75A1. The shaft portion 75C is a part to be rotatably supported by the support portion 72. The shaft portion 75C is formed in a cylindrical shape having a hollow therein. The inner diameter of the shaft portion 75C is greater than the outer diameter of the cylinder portion 74C of the joint 74. Thus, the cylinder portion 74C can be inserted into the inner hole of the shaft portion 75C. In the present embodiment, the cylinder portion 74C is inserted into the inner hole of the shaft portion 75C, whereby the flange 75 and the joint 74 are connected with each other. When the press-fit portion 75D of the joint 74 is fixed at the end portion of the photosensitive drum 11, the shaft portion 75C projects outward in the axial direction from the center of the end portion of the photosensitive drum 11.

Three ribs 75E elongated in the axial direction are formed in the inner circumferential surface of the shaft portion 75C. The ribs 75E are inserted into the long grooves 74C1 of the joint 74. Specifically, when the cylinder portion 74C is inserted into the shaft portion 75C, the ribs 75E are inserted into the long grooves 74C1. In other words, the cylinder portion 74C is inserted into the shaft portion 75C so that the ribs 75E are inserted into the long grooves 74C1. When the ribs 75E are inserted into the long grooves 74C1, the ribs 75E and the engagement grooves 74D1 are engaged with each other in the rotational direction 88. Thus, the rotational drive force in the rotational direction 88 transmitted from the drive input gear 69 to the joint 74 is transmitted from the long grooves 74C1 of the cylinder portion 74C to the ribs 75E of the shaft portion 75C, and then transmitted to the flange 75. Further, the rotational drive force is transmitted to the photosensitive drum 11 via the flange 75, to rotate the photosensitive drum 11 in the rotational direction 88.

Figure 5:
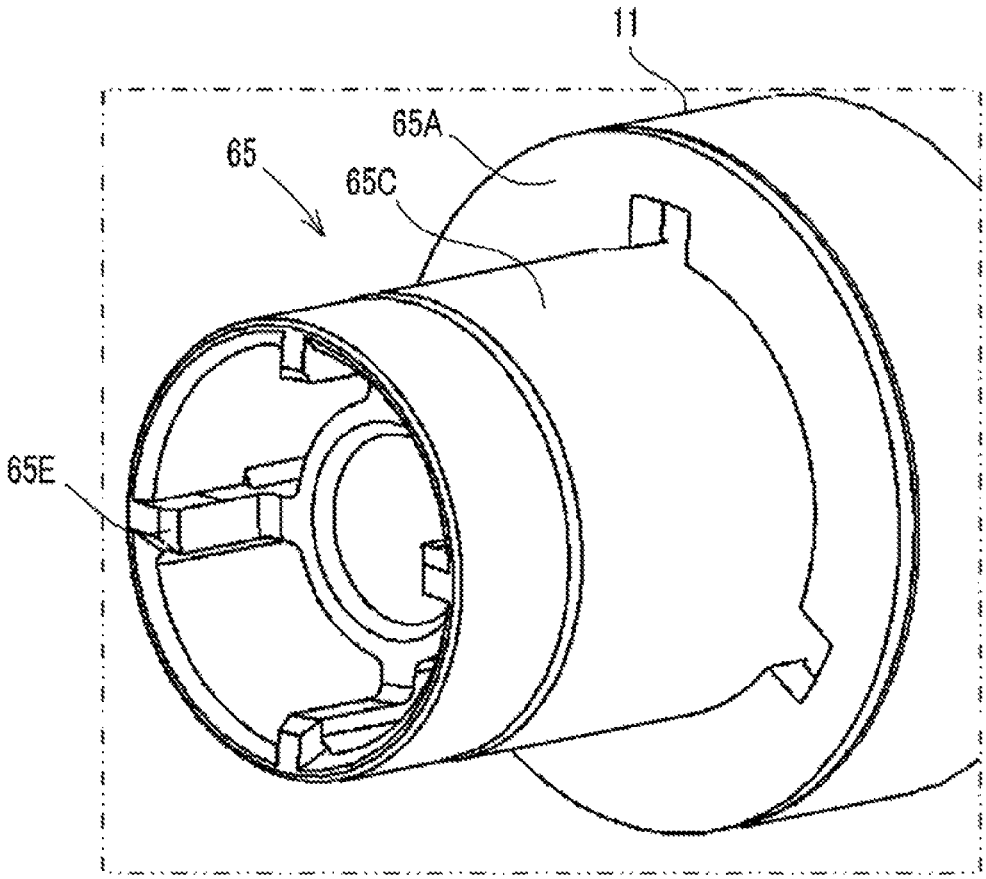
FIG. 5 is a perspective view showing a flange attached to one end of the photosensitive drum.

The flange 65 is attached at the opposite end of the photosensitive drum 11. As shown in FIG. 5, similarly to the flange 75, the flange 65 has a disk-like base body 65A, the shaft portion 65C, a press-fit portion, and ribs 65E. The flange 65 is a resin member formed of a crystalline resin, and is formed of, for example, polyacetal (POM) which has a small friction coefficient and is highly slidable. The shaft portion 65C is a part to be rotatably supported by the support portion 71. The configuration of the flange 65 is the same as that of the flange 75, so the description thereof is omitted.

Figure 7:
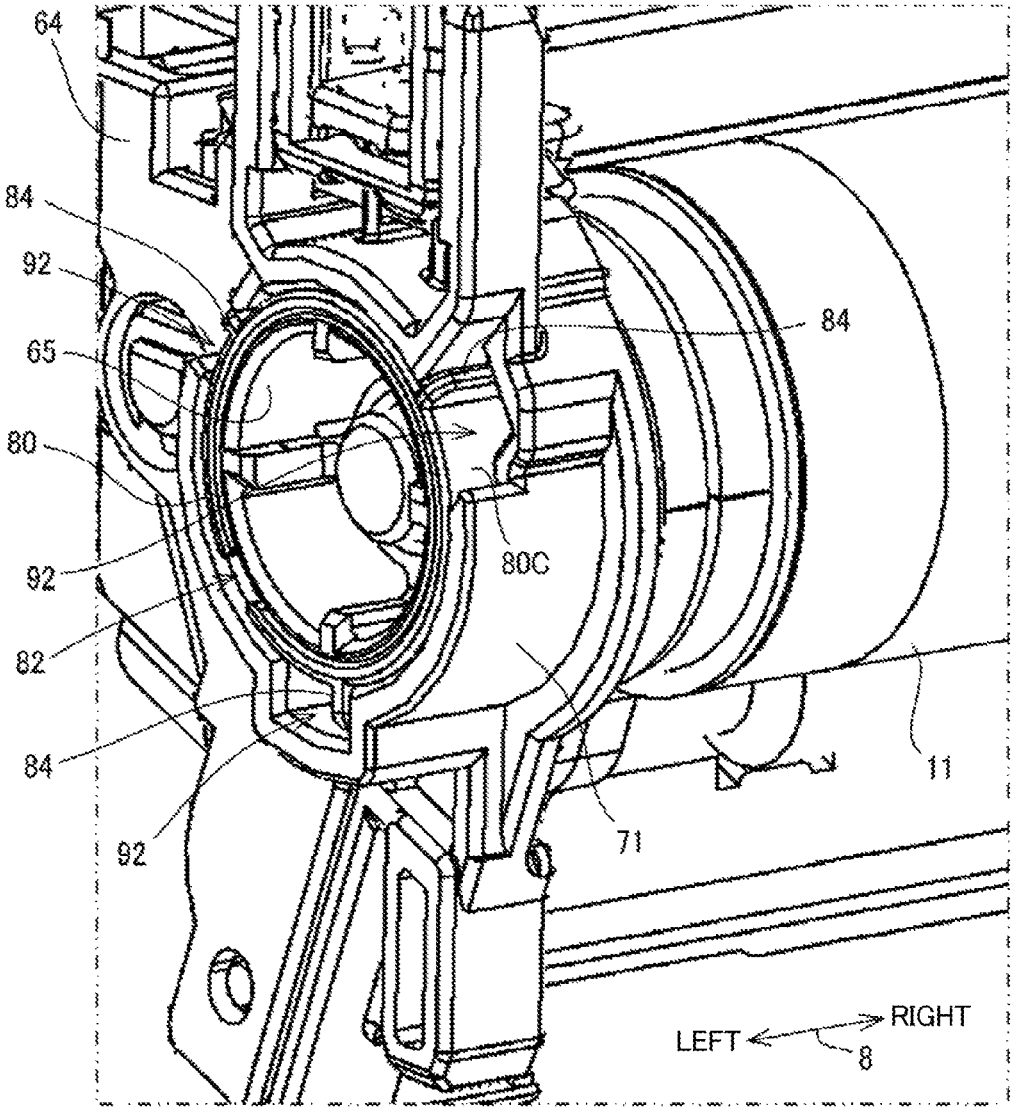
FIG. 7 is an enlarged view showing a support mechanism for a shaft portion of the flange.
Figure 8:
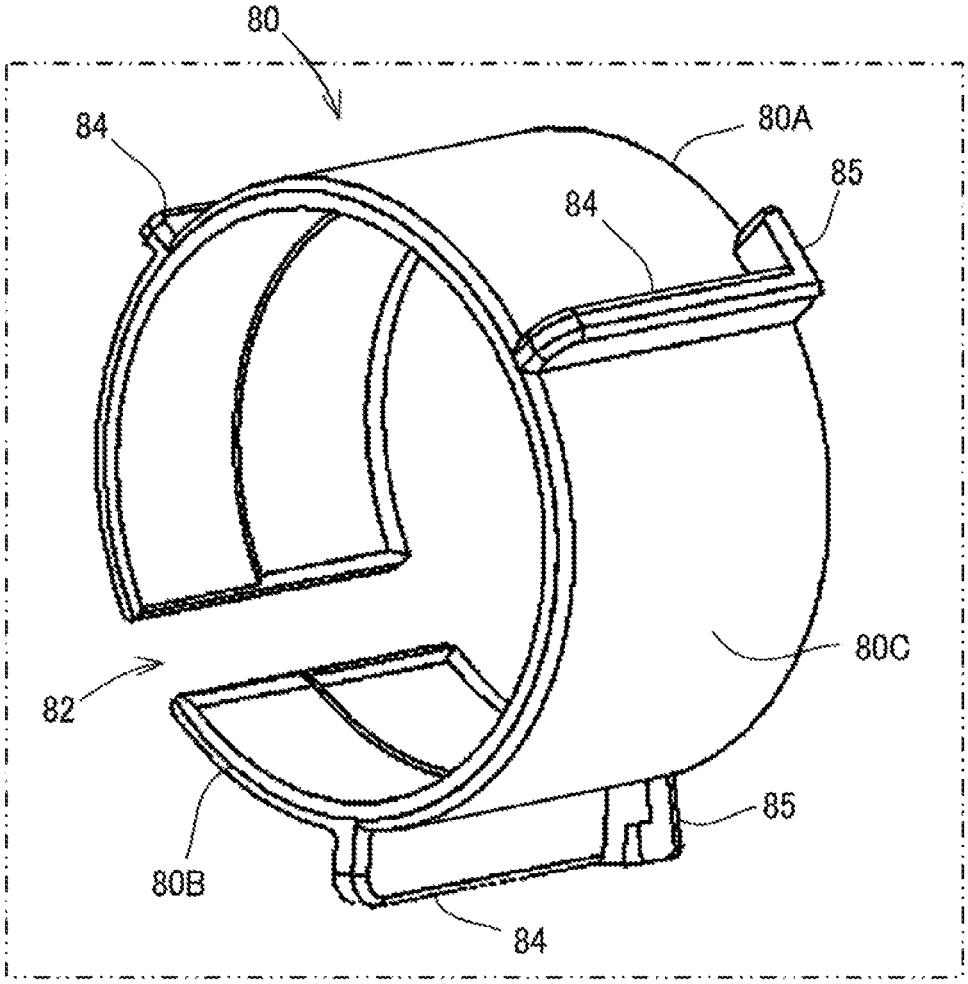
FIG. 8 is a perspective view of a bush member used for supporting the shaft portion of the flange.

Hereinafter, with reference to FIG. 7 to FIG. 11, a support mechanism for the shaft portion 65C will be described. A support mechanism for the shaft portion 75C is the same as the support mechanism for the shaft portion 65C, so the description thereof is omitted. Here, FIG. 7 is an enlarged view showing the support mechanism for the shaft portion 65C. FIG. 8 is a perspective view of the bush member 80 used for supporting the shaft portion 65C.

As shown in FIG. 7, the shaft portion 65C is rotatably supported by the bearing hole 71A (see FIG. 10) of the support portion 71 via the bush member 80. The bush member 80 is interposed in the gap between the inner surface of the bearing hole 71A and the outer circumferential surface of the shaft portion 65C.

As shown in FIG. 8, the bush member 80 is formed in an arc shape. The bush member 80 is a resin member formed of a crystalline resin, and is formed of, for example, polybutylene terephthalate (PBT) which has a small friction coefficient and is highly slidable. The bush member 80 has a slit 82 extending in the axial direction thereof. The bush member 80 is obtained by, for example, creating a molded product having a cylindrical shape using a resin material, and then forming the slit 82 in the outer circumferential wall, along the axial direction. An end portion 80A on one side in the axial direction of the bush member 80 is located on the base body 65A side of the flange 65, and an end portion 80B on the other side is located on the outer end (tip end) side of the shaft portion 65C.

Ribs 84 extending in the axial direction are formed on an outer circumferential surface 80C of the bush member 80. Three ribs 84 are provided at equiangular intervals along the circumferential direction. In the bearing hole 71A, three engagement grooves 92 (see FIG. 10) are formed at positions corresponding to the ribs 84. The engagement grooves 92 are formed at positions that allow the ribs 84 to be inserted therein, and have sizes that allow the ribs 84 to be inserted therethrough. The engagement grooves 92 are an example of a positioning portion of the present disclosure. When the bush member 80 is attached to the bearing hole 71A, the ribs 84 are inserted into the three engagement grooves 92 formed in the bearing hole 71A. At the end on the end portion 80A side of each rib 84, a hook portion 85 is formed which is bent orthogonally in the circumferential direction and has a hook shape. In other words, the hook portion 85 extends from the end on the end portion 80A side of the rib 84 in the direction that is perpendicular to the direction (direction coinciding with the axial direction of the bush member 80) in which the rib 84 extends, and that is along the outer circumferential surface 80C of the bush member 80. When the ribs 84 are inserted into the engagement grooves 92, the ribs 84 and the support portion 71 are engaged with each other in the circumferential direction. Thus, the bush member 80 is positioned in the circumferential direction in the bearing hole 71A of the support portion 71. When the bush member 80 is attached to the bearing hole 71A, the hook portions 85 are located on the inner side in the axial direction with respect to the support portion 71. In detail, the hook portions 85 are located on the support portion 72 side with respect to an edge portion 71B (see FIG. 10) on the support portion 72 (see FIG. 6) side of the support portion 71. Thus, each hook portion 85 is engaged with an edge portion 92A (see FIG. 11) in the circumferential direction of the engagement groove 92, thereby functioning to prevent drop off. Thus, the bush member 80 is prevented from being easily dropped off.

Figure 9:
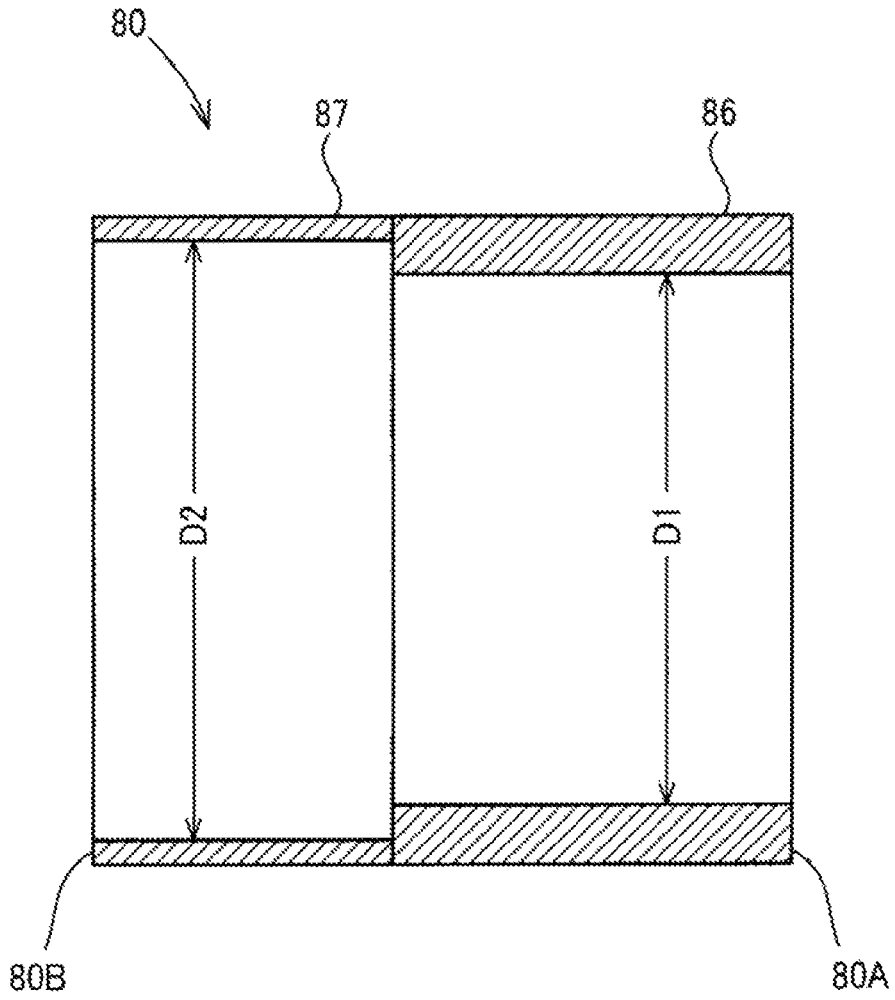
FIG. 9 is a sectional view of the bush member.
Figure 10:
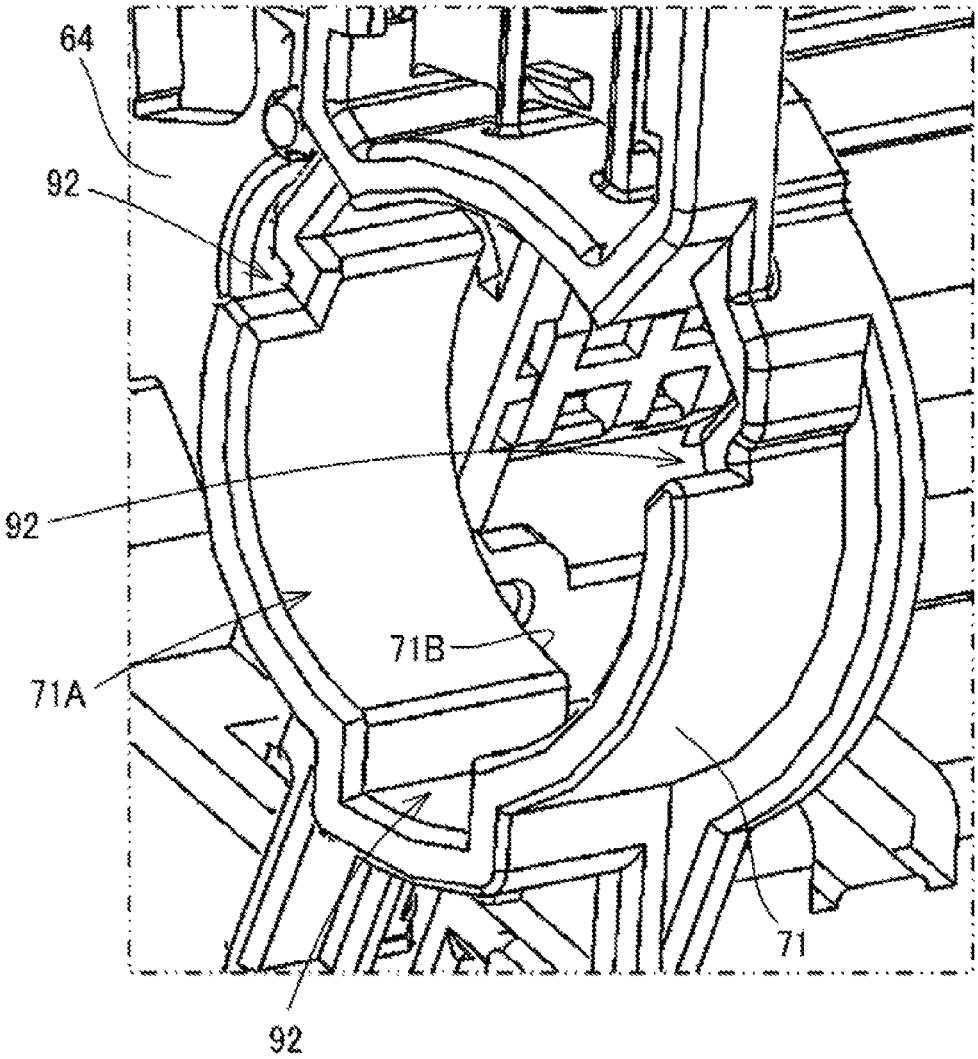
FIG. 10 is an enlarged view showing one of support portions of the housing of the cleaning device.

As shown in FIG. 9, the bush member 80 is composed of two parts 86 and 87 having different inner diameters. The part 86 on the end portion 80A side is a cylinder portion having an inner diameter D1. The part 87 on the end portion 80B side is a cylinder portion having an inner diameter D2 (>D1). When the part 86 is interposed in the gap between the shaft portion 65C and the bearing hole 71A, the outer circumferential surface of the part 86 is in close contact with the bearing hole 71A, and a predetermined sliding clearance (gap between the inner circumferential surface of the part 86 and the outer circumferential surface of the shaft portion 65C) is secured between the inner circumferential surface of the part 86 and the outer circumferential surface of the shaft portion 65C. In the present embodiment, the sliding clearance is set to 0.03 mm under a certain temperature environment (for example, 20° C.). The thickness of the part 86 is set within a range of 0.8 mm to 1.0 mm, and in the present embodiment, set to 1.0 mm.

Figure 11:
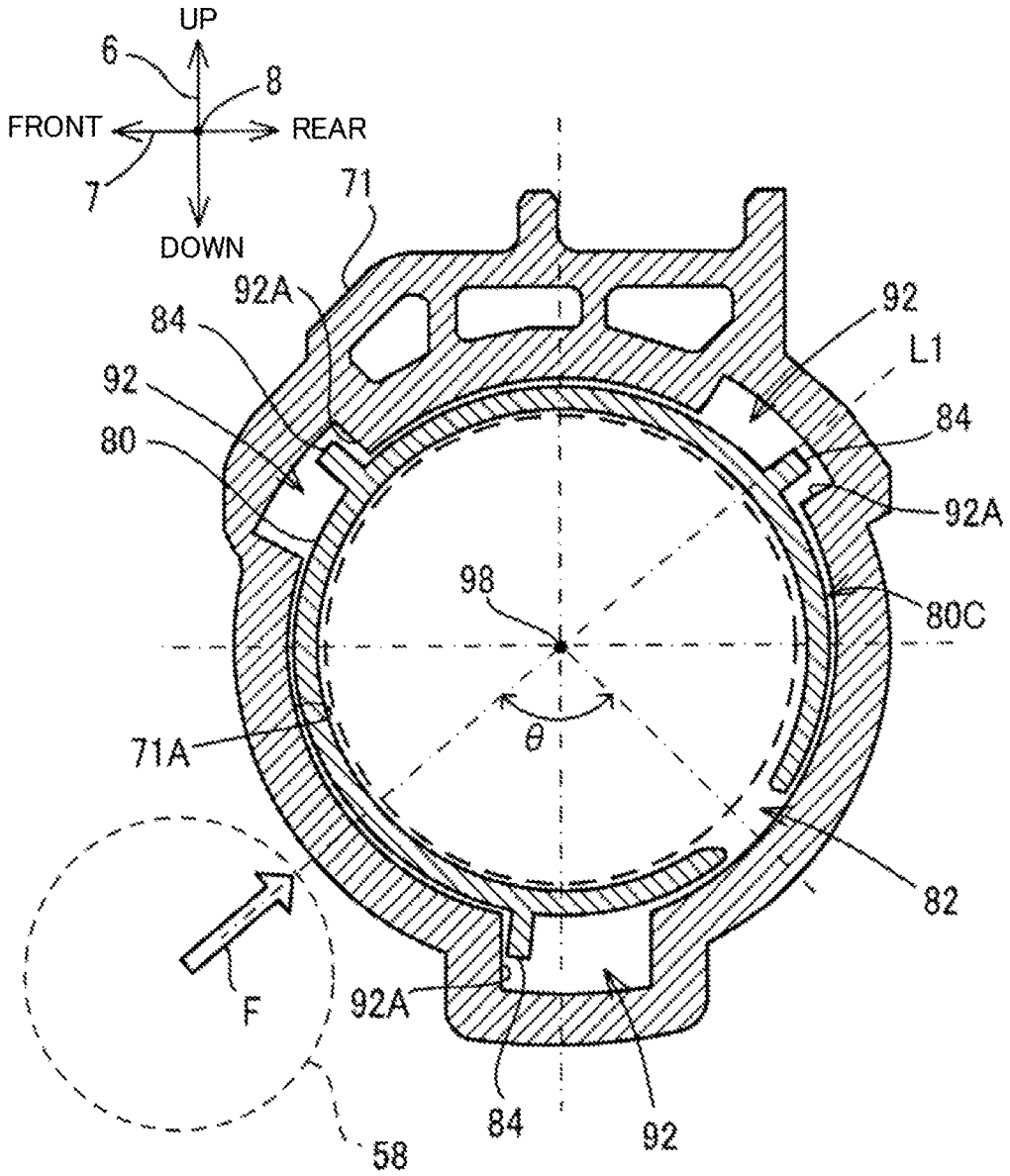
FIG. 11 is a sectional view of the support portion as seen from the direction of an arrow XI in FIG. 6, in which the position of a slit of the bush member is shown.

FIG. 11 is a sectional view of the support portion 71 as seen from the direction of an arrow XI in FIG. 6. FIG. 11 shows the sectional view when the bush member 80 is attached to the bearing hole 71A. As shown in FIG. 11, when the bush member 80 is attached to the bearing hole 71A, the slit 82 is located at a position separated from a reference line L1 connecting a central axis 98 of the photosensitive drum 11 and the center of the developing roller 57, by a predetermined angle θ in the circumferential direction about the center of the central axis 98. In the present embodiment, the angle θ is set to approximately 90 degrees.

In the case of a support mechanism for pivotally supporting the shaft portions 65C and 75C using conventional ring-shaped bush members, when each bush member expands due to temperature change, as well as expansion in the thickness direction, expansion in the circumferential direction acts in the thickness direction, and thus the outer diameter of the bush member increases too much. Therefore, under the assumption that the outer diameter size of the bush member increase due to expansion, gaps (space where the bush member is stored) between the shaft portions 65C and 75C and the bearing holes 71A and 72A are set. In the configuration in which the shaft portions 65C and 75C are supported by using such ring-shaped bush members, when the image forming apparatus 10 is placed in a low-temperature environment, the clearances between the shaft portions 65C and 75C and the bearing holes 71A and 72A become greater than in a high-temperature environment. In this case, so-called runout occurs in which the centers of the shaft portions 65C and 75C are shifted from the centers of the bearing holes 71A and 72A in the radial direction, whereby the photosensitive drum 11 rotationally vibrates.

In the present embodiment, as described above, the bush members 80 having the slits 82 are used for the support mechanisms for the shaft portions 65C and 75C of the photosensitive drum 11. Therefore, when each bush member 80 expands due to temperature change, the bush member 80 deforms in the direction (circumferential direction of the bush member 80) in which the width of the slit 82 is reduced. In addition, the bush member 80 expands also in the thickness direction of the bush member 80, but the expansion amount is smaller than that in the circumferential direction. Therefore, the outer diameter of the bush member 80 is always constant without being influenced by temperature change. Thus, the sliding clearance becomes always constant (for example, 0.03 mm), and therefore, even if the ambient temperature varies, the shift amount of the runout of the photosensitive drum 11 does not vary, and stable rotation is achieved. As a result, image defect such as image deviation or density variation due to unstable rotation can be prevented.

In addition, as described above, the energizing force F in the direction along the reference line L1 is applied from the rotary roller 58. By the energizing force F, a part of the bush member 80, specifically, a part that intersects the reference line L1 is held between each shaft portion 65C, 75C and the inner surface of each bearing hole 71A, 72A. If the slit 82 is located at the held part, even when the bush member 80 expands due to temperature change, the bush member 80 hardly deforms in the direction in which the slit 82 is contracted. In the present embodiment, the angle θ for determining the position of the slit 82 is set to approximately 90 degrees with respect to the reference line L1. Therefore, the slit 82 is not influenced by the energizing force F, and thus, when the bush member 80 expands due to temperature increase, the bush member 80 can deform in the direction in which the width of the slit 82 is reduced.

In the above embodiment, the angle θ for determining the position of the slit 82 of the bush member 80 is set to approximately 90 degrees, but the angle θ is not limited to 90 degrees. The angle θ may be set such that the slit 82 is not located at the part where the bush member 80 and the reference line L1 intersect each other. Specifically, the angle θ may be set to be greater than 0 degrees and smaller than 180 degrees. Preferably, the angle θ is set to be equal to or greater than 60 degrees and smaller than 120 degrees, whereby the influence of the energizing force F can be more reduced.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a photosensitive drum configured to hold a toner image to be transferred to a sheet member;

shaft portions connected to both ends in an axial direction of the photosensitive drum and projecting outward in the axial direction from a center of the photosensitive drum;

support portions having shaft holes through which the shaft portions are inserted, and configured to rotatably support the shaft portions;

bush members interposed between inner surfaces of the shaft holes and outer circumferential surfaces of the shaft portions, and each formed in an arc shape having a slit extending in the axial direction;

a developing roller provided with a predetermined gap from an outer circumferential surface of the photosensitive drum, and configured to hold toner to be adhered to the photosensitive drum;

rotary rollers provided at both ends in the axial direction of the developing roller, and configured to be pressed to both end portions of the outer circumferential surface of the photosensitive drum with a predetermined energizing force, and to position the developing roller at a position separated by the predetermined gap from the photosensitive drum; and positioning portions provided in the support portions and configured to position the bush members at predetermined positions in a circumferential direction, wherein the slit is formed at a position separated from a line connecting the center of the photosensitive drum and a center of the developing roller, by a predetermined angle of 60 to 120 degrees in the circumferential direction of the photosensitive drum.

2. The image forming apparatus according to claim 1, wherein the slit is formed at a position displaced from the line by approximately 90 degrees.

3. The image forming apparatus according to claim 1, wherein at least one rib extending in the axial direction is formed in an outer circumferential surface of each bush member, and each positioning portion is an engagement groove which is formed at a position corresponding to the rib in an inner circumferential surface of the shaft hole, and which is configured to be engaged with the bush member in the circumferential direction, with the rib inserted in the engagement groove.

4. The image forming apparatus according to claim 3, wherein three of the ribs are formed at equiangular intervals along the circumferential direction in the outer circumferential surface of each bush member.

5. The image forming apparatus according to claim 3, wherein a hook-shaped portion bent orthogonally in the circumferential direction is formed at one end in the axial direction of the rib.

6. The image forming apparatus according to claim 1, wherein each bush member is formed of a crystalline resin material and has a thickness not smaller than 0.8 mm and not greater than 1.0 mm.

7. The image forming apparatus according to claim 1, further comprising a cleaning member configured to remove toner left on the photosensitive drum after the toner image is transferred to the sheet member, wherein the support portions are frame members rotatably supporting the photosensitive drum via the shaft portions, and supporting the cleaning member.

* * * * *